US012077889B2

(12) United States Patent
Almog

(10) Patent No.: US 12,077,889 B2
(45) Date of Patent: Sep. 3, 2024

(54) GARMENT WITH UNI-DIRECTIONAL REDUCED-STRETCH PROPERTIES, AND METHOD AND SYSTEM OF PRODUCING SUCH GARMENT

(71) Applicant: Delta Galil Industries Ltd., Caesarea (IL)

(72) Inventor: Eli Almog, Zurit (IL)

(73) Assignee: DELTA GALIL INDUSTRIES LTD., Caesarea (IL)

( * ) Notice: Subject to any disclaimer, the term of this patent is extended or adjusted under 35 U.S.C. 154(b) by 0 days.

(21) Appl. No.: 17/636,038

(22) PCT Filed: Aug. 19, 2020

(86) PCT No.: PCT/IL2020/050909
§ 371 (c)(1),
(2) Date: Feb. 17, 2022

(87) PCT Pub. No.: WO2021/038557
PCT Pub. Date: Mar. 4, 2021

(65) Prior Publication Data

US 2022/0298681 A1 Sep. 22, 2022

Related U.S. Application Data

(60) Provisional application No. 62/891,355, filed on Aug. 25, 2019.

(51) Int. Cl.
*D04B 1/18* (2006.01)
*D04B 1/10* (2006.01)
*D04B 1/24* (2006.01)

(52) U.S. Cl.
CPC ..... *D04B 1/18* (2013.01); *D04B 1/102* (2013.01); *D04B 1/243* (2013.01); *D04B 1/246* (2013.01);

(Continued)

(58) Field of Classification Search
CPC ..... A41C 3/12; A41C 3/0014; A41C 3/0085; D04B 21/207; D04B 21/20
See application file for complete search history.

(56) References Cited

U.S. PATENT DOCUMENTS 6,401,497 B1 6/2002 Nishiyama
7,640,770 B2 1/2010 Miyai
(Continued)

FOREIGN PATENT DOCUMENTS

GB 1470248 A 4/1977

OTHER PUBLICATIONS

International Search Report in PCT/IL2020/050909, dated Oct. 26, 2020.

(Continued)

*Primary Examiner* — Lynda Salvatore
(74) *Attorney, Agent, or Firm* — AlphaPatent Associates Ltd.; Daniel J. Swirsky

(57) ABSTRACT

A garment includes: a first garment-region, that is formed of a knitted material, and that is knitted in accordance with a first knitting pattern, wherein the first garment region has a first value of horizontal stretching capacity; and a second garment-region, that is formed of the same knitted material, and that is knitted in accordance with a second, different, knitting pattern; wherein the second garment region has a second value of unidirectional stretching capacity that is smaller than the first value of unidirectional stretching capacity of the first garment-region. The second garment-region is immediately adjacent to and is bordering with the first garment-region, and together they are a continuous and seamless garment zone.

23 Claims, 14 Drawing Sheets

(52) U.S. Cl.
CPC ..... *D10B 2401/061* (2013.01); *D10B 2403/0241* (2013.01); *D10B 2501/02* (2013.01)

(56) References Cited

U.S. PATENT DOCUMENTS

| | | | | |
|---|---|---|---|---|
| 2002/0152775 | A1 | 10/2002 | Browder | |
| 2012/0277649 | A1 | 11/2012 | Matsuo | |
| 2017/0290376 | A1 * | 10/2017 | Maheshwari | D04B 21/207 |

OTHER PUBLICATIONS

Written Opinion of the International Searching Authority in PCT/IL2020/050909, dated Oct. 26, 2020.
Search Report in European patent application No. EP 20858838.4, dated Aug. 25, 2023.

* cited by examiner

| | | | |
|---|---|---|---|
| M | P | M | P |
| M | P | M | P |
| P | M | P | M |
| P | M | P | M |
| M | P | M | P |
| M | P | M | P |
| P | M | P | M |
| P | M | P | M |

101

Fig. 11A

| | | | |
|---|---|---|---|
| H | P | H | P |
| P | P | P | P |
| P | H | P | H |
| P | P | P | P |
| H | P | H | P |
| P | P | P | P |
| P | H | P | H |
| P | P | P | P |

102

Fig. 11B

| | | | |
|---|---|---|---|
| P | P | M | M |
| M | H | M | H |
| M | M | P | P |
| M | H | M | H |
| P | P | M | M |
| M | H | M | H |
| M | M | P | P |
| M | H | M | H |

103

Fig. 11C

GARMENT WITH UNI-DIRECTIONAL REDUCED-STRETCH PROPERTIES, AND METHOD AND SYSTEM OF PRODUCING SUCH GARMENT

CROSS-REFERENCE TO RELATED APPLICATIONS

This patent application is a National Stage of PCT international application number PCT/IL2020/050909, having an international filing date of Aug. 19, 2020, published as international publication number WO 2021/038557 A1, which is hereby incorporated by reference in its entirety; which claims priority and benefit from US 62/891,355, filed on Aug. 25, 2019, which is hereby incorporated by reference in its entirety.

FIELD

The present invention relates to the field of clothing articles.

BACKGROUND

Clothes are worn by billions of people worldwide, and are typically made of fabrics or textiles. Clothes may protect the body of the wearer from sunshine or from rain, from rough surfaces, from plants and insects, from harsh weather conditions, and from other environmental hazards. Clothes also hide private parts of the wearer, and are also worn as a fashion article and for social purposes.

SUMMARY

The present invention comprises garments with unidirectional reduced-stretch properties, and method and system of producing such garments.

BRIEF DESCRIPTION OF THE DRAWINGS

FIGS. 11A-11D are schematic illustrations of knitting patterns, in accordance with some demonstrative embodiments of the present invention.

DETAILED DESCRIPTION OF SOME DEMONSTRATIVE EMBODIMENTS

Figure 1B:
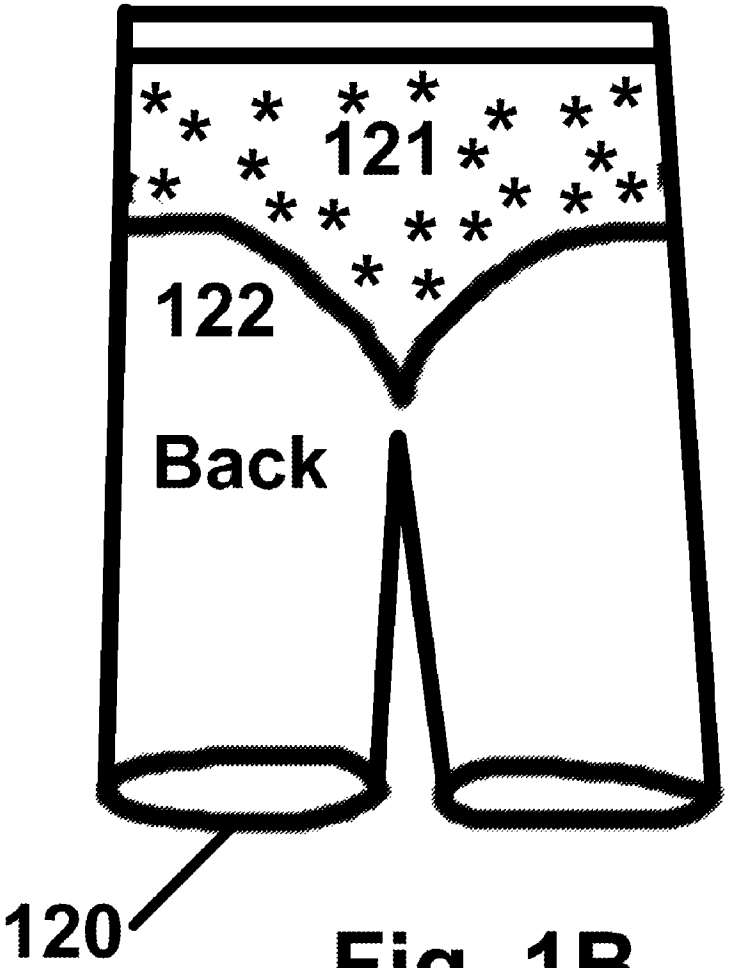
FIGS. 1A and 1B are schematic illustrations of a front side and a back side (respectively) of a garment having reduced-stretch region(s) and conventional stretch region(s), the garment being for example a slimmer or body shaper garment, in accordance with some demonstrative embodiments of the present invention.

The present invention includes garments and clothes and clothing articles, in which a particular region or zone or area or portion of the garment, or a particular group of zones or regions or areas or portions of the garment, or the entirety of the garment, are able to stretch only horizontally, or are able to stretch only vertically, or are able to stretch only in a particular diagonal or slanted direction, and are not able to stretch (at all, or more than a pre-defined percentage value that is regarded as negligible or insignificant) in other directions.

Such unidirectional stretching properties may enable the garment to provide improved body support, improved body fitting, improved form-fitting, enhanced feeling of convenience, and/or may avoid a situation in which the garment (or portions thereof) become loose or too loose or non-supporting.

In some embodiments, the garment-region is able to stretch horizontally by H percent relative to its idle state or to its non-stretched state; and the same garment-region is able to stretch vertically by V percent relative to its idle state or its non-stretched state; such that H is at least 1.25 times V, or such that H is at least 1.3 times V, or such that H is at least 1.35 times V, or such that H is at least 1.5 times V, or such that H is in the range of 1.25V to 1.5V. Additionally or alternatively, in some embodiments, the vertical stretch (V) is negligible or insignificant, such as, V being zero, or V being 3 or 5 percent, or V being 7 or 10 percent, or V being smaller than 5 percent, or V being smaller than 10 percent.

In some embodiments, the garment-region is able to stretch vertically by V percent relative to its idle state or to its non-stretched state; and the same garment-region is able to stretch horizontally by H percent relative to its idle state or its non-stretched state; such that V is at least 1.25 times H, or such that V is at least 1.3 times H, or such that V is at least 1.35 times H, or such that V is at least 1.5 times H, or such that V is in the range of 1.25H to 1.5H. Additionally or alternatively, in some embodiments, the horizontal stretch (H) is negligible or insignificant, such as, H being zero, or H being 3 or 5 percent, or H being 7 or 10 percent, or H being smaller than 5 percent, or H being smaller than 10 percent.

In some embodiments, the garment-region is able to stretch along a first direction that is non-horizontal and non-vertical, such as, along a first diagonal direction, by D1 percent relative to its idle state or to its non-stretched state; and the same garment-region is able to stretch, at a second direction that is perpendicular to said first direction (e.g., along a second diagonal direction that is perpendicular to the first diagonal direction) by D2 percent relative to its idle state or its non-stretched state; such that D1 is at least 1.25 times D2, or such that D1 is at least 1.3 times D2, or such that D1 is at least 1.35 times D2, or such that D1 is at least 1.5 times D2, or such that D1 is in the range of 1.25 D2 to 1.5 D2. Additionally or alternatively, in some embodiments, the second diagonal stretch (D1) is negligible or insignificant, such as, D2 being zero, or D2 being 3 or 5 percent, or D2 being 7 or 10 percent, or D2 being smaller than 5 percent, or D2 being smaller than 10 percent.

In some embodiments, the garment may be, for example, a shirt, a form-fitting shirt, a tank or tank-top, a sleeveless shirt, a T-shirt, a shaper, a body shaper, a swimsuit, a bra, a camisole, a lingerie item, underwear, or other suitable garment. For example, it may be desired that a particular region of a body shaper would be able to stretch vertically (e.g., to allow the wearer to bend down, or to accommodate the vertical curving or stretching of the wearer's body during a fitness exercise), while at the same time, not allowing that garment region to stretch horizontally, and maintaining a no-stretch or zero-stretch or insignificant-stretch or negligible-stretch in the horizontal axis or direction (e.g., to keep the garment form-fitting or body-fitting in the horizontal direction). In other embodiments, the desired and non-desired directions of stretching, may be switched in order to achieve other goals.

In accordance with the present invention, a particular region of the garment has a no-stretch or zero-stretch or insignificant-stretch or negligible-stretch in one particular direction; while the same garment-region has other, increased, stretch property at a direction that is perpendicular to said direction. Additionally or alternatively, other regions of the same garment, may have regular stretch properties in all directions, without necessarily limiting the stretch properties of such other garment-regions in any particular directions.

In some embodiments, a single garment may comprise at least two different garment regions: (I) a first garment region, having increased Vertical stretch property, and having reduced or negligible Horizontal stretch property; and (II) a second garment region, having non-increased and non-reduced Vertical stretch property and having non-increased and non-reduced Horizontal stretch property.

In some embodiments, a single garment may comprise at least two different garment regions: (I) a first garment region, having increased Horizontal stretch property, and having reduced or negligible Vertical stretch property; and (II) a second garment region, having non-increased and non-reduced Vertical stretch property and having non-increased and non-reduced Horizontal stretch property.

In some embodiments, a single garment may comprise at least two different garment regions: (I) a first garment region, having increased stretch property along a first diagonal (non-horizontal and non-vertical) direction, and having reduced or negligible stretch property along a second diagonal direction that is perpendicular to the first direction; and (II) a second garment region, having non-increased and non-reduced stretch property along the first direction and having non-increased and non-reduced stretch property along the second diagonal direction.

In some embodiments, a single garment may comprise at least three different garment regions: (I) a first garment region, having increased Vertical stretch property, and having reduced or negligible Horizontal stretch property; and (II) a second garment region, having non-increased and non-reduced Vertical stretch property and having non-increased and non-reduced Horizontal stretch property; and (III) a third garment region, having increased Horizontal stretch property, and having reduced or negligible Vertical stretch property.

In some embodiments, a single garment may comprise at least three different garment regions: (I) a first garment region, having increased Horizontal stretch property, and having reduced or negligible Vertical stretch property; and (II) a second garment region, having non-increased and non-reduced Vertical stretch property and having non-increased and non-reduced Horizontal stretch property; and (III) a third garment region, having increased Vertical stretch property, and having reduced or negligible Horizontal stretch property.

In some embodiments, a single garment may comprise at least three different garment regions: (I) a first garment region, having increased stretch property along a first diagonal (non-horizontal and non-vertical) direction, and having reduced or negligible stretch property along a second direction that is perpendicular to the first direction; and (II) a second garment region, having non-increased and non-reduced stretch property along the first direction and having non-increased and non-reduced stretch property along the second direction; and (III) a third garment region, having increased stretch property along the second diagonal direction, and having reduced or negligible stretch property along the first diagonal direction.

In some embodiments, the garment is a seamless garment (e.g., a seamless shaper, a seamless body shaper, a seamless tank or tank-top, a seamless sleeveless shirt, or the like), such that two or more garment regions (e.g., having different stretch properties) are produced in a seamless manner that excludes seams, and/or such that the multiple garment-regions are produced in a single, seamless, knitting process or production process; for example, using a programmable knitting machine that is able to continuously knit one garment-region after another, in the same garment, while producing garment-regions having different or varying or differential stretch properties in particular direction(s).

It is clarified that the terms "zero stretch" or "no stretch" or "reduced stretch" or "low stretch", as used above and/or herein, may refer to a property of the garment or of the fabric or of a garment-region, such that upon application of force by a human wearer in the regular course of activities (e.g., running, walking, bending, jumping, reaching up, reaching down, stretching the body, stretching a body organ, exercising, or the like), the garment-region does not stretch at all in a particular direction (e.g., horizontally; or vertically; or diagonally), or stretches up to 5 percent relative to its original or non-stretched or idle state; whereas, the same garment-region, upon application of said force or other force by a human wearer, is capable of stretching by at least 5 percent relative to its original or non-stretched or idle state.

In some embodiments, particularly when the garment is a body shaper or a similar garment, the garment may have a horizontal no-stretch or zero-stretch or stretch-less region which significantly limits the ability of the garment or the garment-region to stretch horizontally (e.g., allowing up to 5 percent of horizontal stretching), while limiting to a lesser degree (e.g., enabling to a higher degree) the ability of that garment or garment-region to stretch vertically (e.g., allowing it to stretch vertically by more than 10 percent of vertical stretching, or by at least twice as many percent points of the percent points of horizontal stretching). This may allow such body-shaper garment to effectively hold in place the body regions that it is intended to hold and to shape horizontally, while at the same time enabling the garment to stretch vertically and accommodate its vertical length or vertical size to motions such as standing up or sitting down or bending down or reaching up, and preventing the garment from "spilling" or moving vertically or downwardly along the body of the wearer upon such body motion.

In some embodiments, the horizontal stretching property of the garment or of the garment-region, is at least 15 or 20 or 25 or 30 or 33 percent smaller, relative to the vertical stretching property of the same garment or the same garment-region, respectively.

In some embodiments, optionally, a reduced-stretch garment-zone, or an increased-stretch garment-zone, may include within such garment-zone a differential or varying set of sub-regions having different stretch properties. This may be implemented, optionally, as a gradual scale of stretch properties in a 360 degrees garment-region or garment-portion which is capable of surrounding or encircling a particular body-area or body-organ (e.g., the waist; the stomach or belly; the chest; or the like).

For example, a reduced-stretch or negligible-stretch garment-zone, may have a first sub-region which may stretch by up to 3 percent horizontally, adjacent to a second sub-region which may stretch by up to 5 percent horizontally, adjacent to a third sub-region which may stretch by up to 3 percent horizontally; thereby creating a gradual or differential multiple-sub-regions or multiple-zones garment-region.

Similarly, for example, an increased-stretch garment-zone, may have a first sub-region which may stretch by up to 20 percent horizontally, adjacent to a second sub-region which may stretch by up to 25 percent horizontally, adjacent to a third sub-region which may stretch by up to 20 percent horizontally; thereby creating a gradual or differential multiple-sub-regions or multiple-zones garment-region.

In some embodiments, one or more garment-region may have Vertical reduced-stretch or no-stretch or low-stretch or negligible stretch; for example, in the straps of a bra or a brassiere or other lingerie item, or in the shoulder straps of a sleeveless shirt or a tank or a tank-top, or near or around the chest area or the breast area of the wearer; as in such implementations, it may be desired to prevent the garment-region to stretch Vertically, in order to reduce to a minimum (or to prevent) the movement or motion of the chest or breasts of the wearer, such as during fitness sessions or exercising or running or jogging.

In some embodiments, the reduced-stretch or low-stretch garment-region, may be knitted or produced or manufactured by using one or more suitable knitting techniques, by using one or more suitable yarns, in accordance with a particular knitting density, and optionally by utilizing one or more yarn processing or fabric processing operations which may be performed prior to the knitting and/or subsequent to the knitting.

The present invention may include various types of Seamless body-shapers and other garments, featuring one or more "zero stretch" or "low stretch" or "reduced stretch" or "negligible stretch" garment-region(s), that have reduced stretching capability along the horizontal axis, or along the vertical axis, or along a diagonal (non-horizontal non-vertical) axis or direction. As explained above, in some embodiments, the term "zero stretch" may include near-zero or almost-zero or significantly low percentage of stretching ability (e.g., less than 5 percent of stretching capability, upon regular human force application due to regular human exercising).

Some embodiments may feature one or more Horizontal low-stretch or reduced-stretch or "zero stretch" garment-regions. The purpose of such embodiments is, for example, to enable the garment (e.g., body shaper) to gather or "collect" and to smooth the surplus limbs/zones/body areas by the vertical "zero stretch" fabric, and at the same time to allow the fabric to stretch horizontally in order to secure that the garment will not slide down during seating or bending or other movements of the wearer.

For demonstrative purposes, the following is a non-limiting example of yarn combination knitting structure:

Yarns:

Odd feeds: DTY Nylon 40D \96F\1, knitted together with Spandex 20D D.C Nylon 10D\7F.

Even feeds: FDY Nylon 30D \68F, knitted together with bare Spandex 40D.

Knitting technique:

Utilizing a Seamless knitting machine, which is circular and has 8 feeders.

The below DIS programs represent the repeat of the needles knitting structure;

Vertically represent the 8 feeds repeat,

Horizontally represent the needles repeat.

Reference is made to FIG. 11A, which is a schematic illustration of a knitting pattern 101, in accordance with some demonstrative embodiments of the present invention. Knitting pattern 101 may be, for example, a DIS repeat program for a Horizontal zero-stretch or reduced-stretch garment-zone or garment-region.

For example, to produce a High Waist Tight Slimmer body-shaper, on Seamless 40 gg machine, in the waistband and waist areas (including the Tummy and the back) the process knits the "Zero Stretch" fabric with 1×1 plain X miss horizontally, while each miss needles knitted for 2 rows (or for 3 rows, or for other number of rows), such as per the repeat knitting pattern 101; "M" indicates Miss knitting, and "P" indicates Plain knitting.

In the above example, the garment-region or the zone is able to stretch vertically approximately 40 percent more than it is able to stretch horizontally (e.g., upon application of the same amount of human force; or, upon application of regular human force during exercising activity or body-stretching activity).

Additionally or alternatively, the garment-zone or garment-region is able to stretch vertically, approximately 46 percent less than the stretching ability of the buttocks area.

Reference is made to FIG. 11B, which is a schematic illustration of a knitting pattern 102, in accordance with some demonstrative embodiments of the present invention.

Knitting pattern 102 may be used, for example, as a DIS repeat program of Horizontal "Zero Stretch" zone for the buttocks area. For example, the buttocks area is knitted mesh 1×1 on the Odd feeds, as per the repeat knitting pattern 102, in which "H" indicates Mesh knitting, and "P" indicates Plain knitting.

Some embodiments utilize a full electronic 360 degrees seamless knitting machines, which may thus enable to selectively and/or separately control and/or program each needle, in every row, and therefore may allow a large number of knitting variations or knitting versions near or around "zero stretch" zone.

Knitting density may further be adjusted or modified, for each zone or garment-region; for example, by setting or changing the size of the knitting stitch electronically, via the computer programing of the DISCOVER program machine.

Some embodiments may feature one or more Vertical low-stretch or reduced-stretch or "zero stretch" garment-regions.

For example, such embodiments may enable to produce a garment, particularly a body shaper or a sports-wear garment, which is capable of stretching horizontally for comfort wearing, and while at the same time also preventing or minimizing the vertical movement of certain garment-zones or garment-regions.

For example, in a shaping bra or a High Impact Sport Bra of the present invention, it is desired: (i) to knit the breasts cups with more stretchy fabric or having regular stretch properties or (in some implementations) increased stretch properties; yet also, (ii) around the cups and in the shoulder zone, to knit Seamlessly a "zero stretch" fabric, which will hold the breast and will reduce the breasts movement as much as possible, such as, to enable easier and more convenient sport activity and/or to reduce embarrassment and/or to enhance modesty, or for holding the breasts in place for shaping purposes and/or to improve their appearance.

For demonstrative purposes, the following is a non-limiting example of yarn combination knitting structure, which may be used to knit the area that Surrounds the cup or Encircles the cup:

Yarns:

Odd feeds: DTY Nylon 70D\68F\4 knitted with Bare Spandex 70D.

Even feeds: bare Spandex 140D.

Knitting technique:

For example, in a 28 gg Bra, the present invention may provide knitting of vertical "zero stretch" fabric around the cups.

The Even feeds with 1×1 Miss X Laid in (Black=Miss, and the Red=laid in);

the Odd feeds 2×2 clear miss.

Reference is made to FIG. 11C, which is a schematic illustration of a knitting pattern 103, in accordance with some demonstrative embodiments of the present invention. Knitting pattern 103 may be used, for example, as a DIS repeat program of Vertical "Zero Stretch" zone which may be knitted around the cup and/or surrounding the cup and/or encircling the cup of a bra or brassiere or a similar garment that covers the chest of a human wearer. For example, "P" indicates plain knitting, "M" indicates Miss knitting, and "H" indicates Mesh knitting, which is a non-limiting example of knitting of the area that Surrounds the cup or Encircles the cup.

Such knitting pattern may enable the cup zone to stretch vertically approximately 50 or 60 percent less (or: at least 50 percent less), relative to the horizontal stretch capability; yet also enabling the cup zone to stretch vertically 10 or 15 or 20 or 25 percent more (or: at least 10 percent more), relative to the structure around the cup (the structure that surrounds the cup); and enabling the cup structure to stretch horizontally at least 50 percent more, relative to the structure around the cup.

Figure 11D:
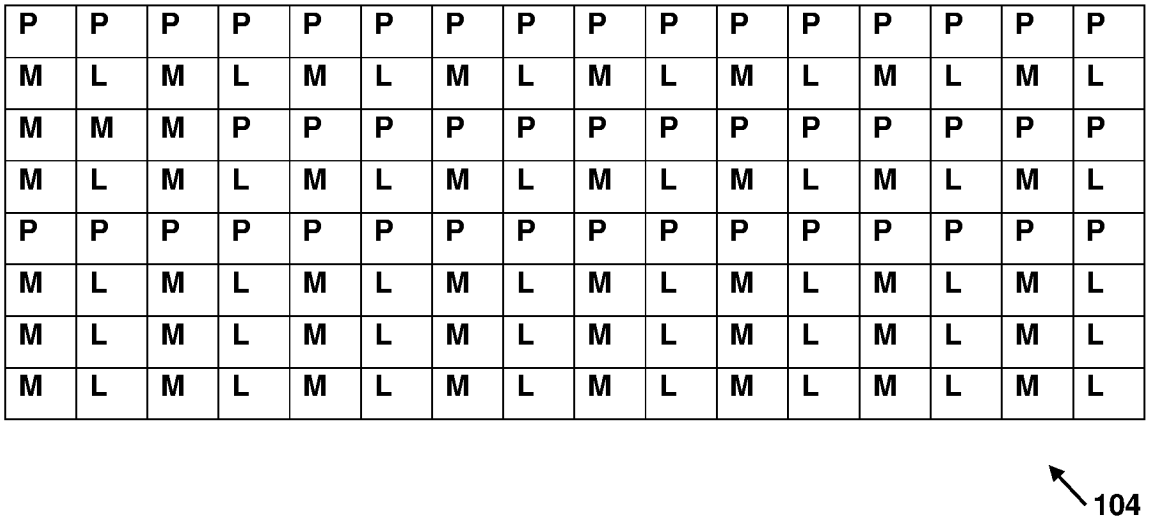

Reference is made to FIG. 11D, which is a schematic illustration of a knitting pattern 104, in accordance with some demonstrative embodiments of the present invention. Knitting pattern 104 may be used, for example, as a DIS repeat pattern for the cups zone or the major cups zone. Knitting pattern 104 is a non-limiting example of yarn combination knitting structure, which may be used to knit the area of the cup itself, or within the cup itself.

For example:

Feeds 1+5 (out of 8 feeds) are knitted with plain knitting (indicated with "P");

Feeds 3+7 are knitted 13 clear (Plain)×3 miss (indicated with "M");

The Even feeds are knitted with 1×1 Miss X Laid In ("M" indicates Miss; and "L" indicates "Laid In").

Knitting density may further be adjusted or modified, for each garment-zone or garment-region; for example, by setting or changing the size of the knitting stitch electronically, via the computer programming of the DISCOVER program machine.

In accordance with the present invention, various combination of reduced-stretch zone(s) and/or increased-stretch zone(s) and/or regular (non-increased and non-reduced) stretch zone(s) may be combined into a single garment, optionally using Seamless knitting and continuous and seamless connection(s) among the different zones of the garment.

In a first example, the Cup area of a garment (e.g., a bra; a sports bra; a fitness bra) may have low-stretch or zero-stretch or reduced-stretch in the Vertical direction, while at the same time may have regular stretch or (alternatively) increased stretch in the Horizontal direction; to prevent the breast of the wearer from moving downwardly and/or upwardly when the wearer is jogging or running or exercising or jumping, while also enabling the breast of the wearer to achieve some movement horizontally to accommodate such motion of the body. For example, the Cup zone itself, is capable of stretching Vertically, at least 30 or 50 or 60 percent Less relative to its ability to stretch Horizontally.

In a second example, the Cup area of the garment is knitted such that it is capable of stretching Vertically less than Horizontally; but also, such that the Vertical stretch capability of the Cup zone itself, is greater (by at least 12 or 15 or 20 percent more) relative to the Vertical stretch capability of the area that Surrounds/Encircles the cup.

In a third example, the Cup area of the garment is knitted such that it is capable of stretching Horizontally, at least 30 or 50 or 60 percent more, relative to the Horizontal stretch capability of the area that Surrounds/Encircles the cup.

In some embodiments, a single garment (e.g., a single bra, a single sports bra, or the like) may feature a Combination of two or of three of the features that are described above in the examples, and/or another combination of any of the examples that are disclosed above or herein.

In some embodiments, the capability or the ability of a particular zone to be Stretched, may be measured in distance units or in length units (e.g., centimeter or inch) in response to application of a particular amount of force (e.g., a force of F Newtons that pulls apart of stretches the material to two opposite directions) relative to the "idle state" of that area or zone (e.g., without any force applied to it). For example, to demonstrate such measurements: a garment-portion or a fabric-portion measures 10 cm by 10 cm in its idle state; a force of 5 Newtons is applied to stretch it Vertically, and causes the fabric to stretch Vertically to have a new vertical length of 12 cm, which corresponds to 20 percent of Vertical stretch capability; the same force of 5 Newtons, when applied to stretch it Horizontally, causes the fabric to stretch Horizontally to have a new horizontal length of 15 cm, which corresponds to 50 percent of Horizontal stretch capability. Such fabric-portion or garment-portion thus us Increased stretch capability in the Horizontal direction, relative to its stretch capability in the Vertical direction. The relative increase can be measured or expressed, for example, as the ratio of 1.50 (the Horizontal stretch) over 1.20 (the Vertical stretch), or by stating that the Horizontal stretch capability is 25 percent greater than the Vertical stretch capability (since 1.50/1.20 is 1.25, which is 25 percent more). Other suitable methods may be used to measure the Stretch capability of a particular fabric-portion or garment-region or garment-zone.

In some embodiments, the garment-region that has unique or different or differential stretch capabilities, or reduced-stretch or increased-stretch capabilities, may have the Same visual appearance as other garment-regions or garment-zones, and/or may have the same Touch Feel as such other garment-regions or garment-zones; for example, without showing or having any additional or excessive "lines" or "ribs" or "accordion knitting" or "channels" that run along a particular direction and that are not featured in those other garment-regions. Accordingly, the present invention may include garments in which the differential stretch capabilities of the various garment-regions are Not necessarily accompanied by (or created by) a different look-and-feel or different Thickness or different Yarns or other three-dimensional effects such as "ribs" or "channels". Rather, in some embodiments, the final garment may have a Unified look-and-feel that does Not necessarily show or does Not necessarily disclose to an observer which garment-regions have the different or differential stretch capabilities; and the final garment may have a unified, continuous, seamless structure.

In some embodiments, the reduced-stretch or the zero-stretch region(s) of the clothing article, or the region(s) of the clothing article that have a reduced capacity to stretch due to application of human force(s) by the wearer, may comprise an additional yarn (or, in some implementations, two or more additional yarn) that is (or are) knitted only in such region(s), and not in the conventional stretch regions; and such additional yarn(s) may be knitted in the reduced-stretch or zero-stretch region(s) in order to further enable the reduced stretch properties of those region(s), via a suitable knitting pattern or method, using one or more knitting needles or knitting needle arrangements or patterns, using a knitting pattern of (for example) 1×1 or 1×2 or 2×1 or 2×3 or 3×1 or 1×3 or the like. Such additional yarn(s) may be of the same type of the yarn that is utilized as the primary yarn in the reduced-stretch or zero-stretch region, or may be of the same type that is utilized in the conventional stretch regions; or may be of a different type from the above-mentioned yarn(s); or may be of the same type of yarn but may have a different property (e.g., the additional yarn being thicker than, or thinner than, the other yarn that forms the reduced-stretch or the zero-stretch regions, or than the other yarn that forms the conventional stretch region).

Reference is made to FIGS. 1A to 10B, which further demonstrate some garments and garment-regions or garment-zones having low-stretch or reduced-stretch or zero-stretch properties, in a particular direction, in accordance with some demonstrative embodiments of the present invention.

Figure 1A:
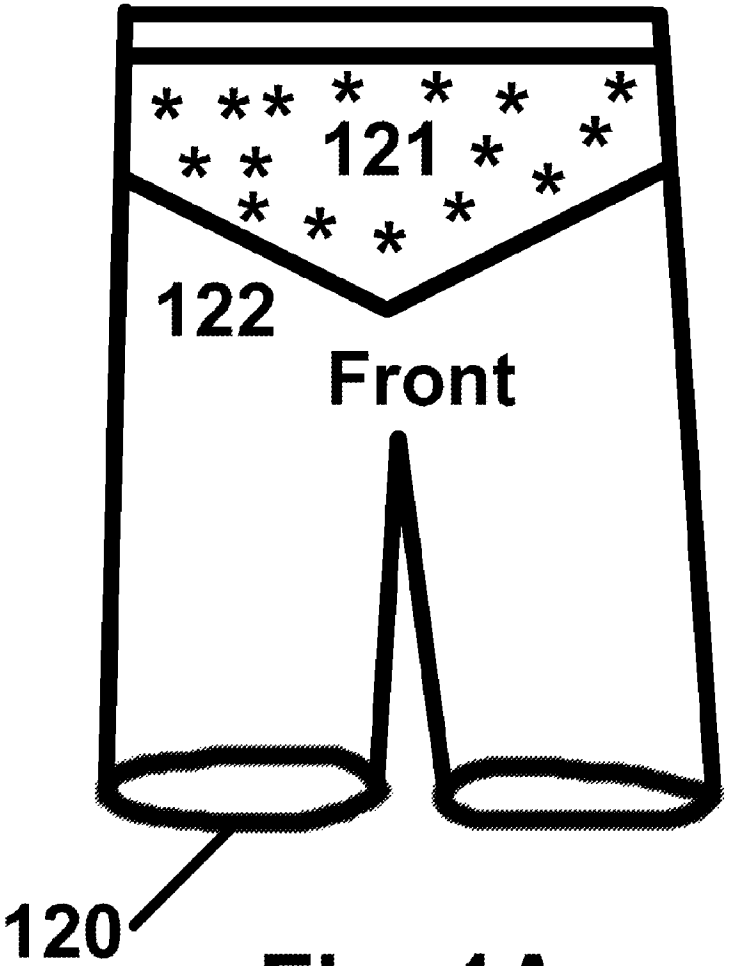

Reference is made to FIGS. 1A and 1B, which are schematic illustrations of a front side and a back side (respectively) of a garment 120 having a reduced-stretch region 121 (which has reduced Horizontal stretch properties) and an adjacent and bordering (e.g., seamlessly neighboring) conventional (e.g., non-reduced) stretch region 122 (which has conventional stretch properties), in accordance with some demonstrative embodiments of the present invention. Garment 120 may be, for example, a tight slimmer or a body shaper garment, or a high-waist slimmer or body shaper garment. Region 121 is further marked with stars, for illustrative purposes. In some embodiments, the capability of region 122 to stretch horizontally, is at least 5 percent greater than the capability of region 121 to stretch horizontally; for example, region 121 has a horizontal stretching capability of K percent; and region 122 has a horizontal stretch capability of at least 1.05 K percent. In other embodiments, the capability of region 122 to stretch horizontally, is at least 10 percent greater than the capability of region 121 to stretch horizontally; for example, region 121 has a horizontal stretching capability of K percent; and region 122 has a horizontal stretch capability of at least 1.10 K percent. In some embodiments, optionally, a waist-band that is located above region 121 is also a reduced-stretch zone; whereas in other embodiments, the waist-band that is located above region 121 is a conventional-stretch zone.

Figure 2B:
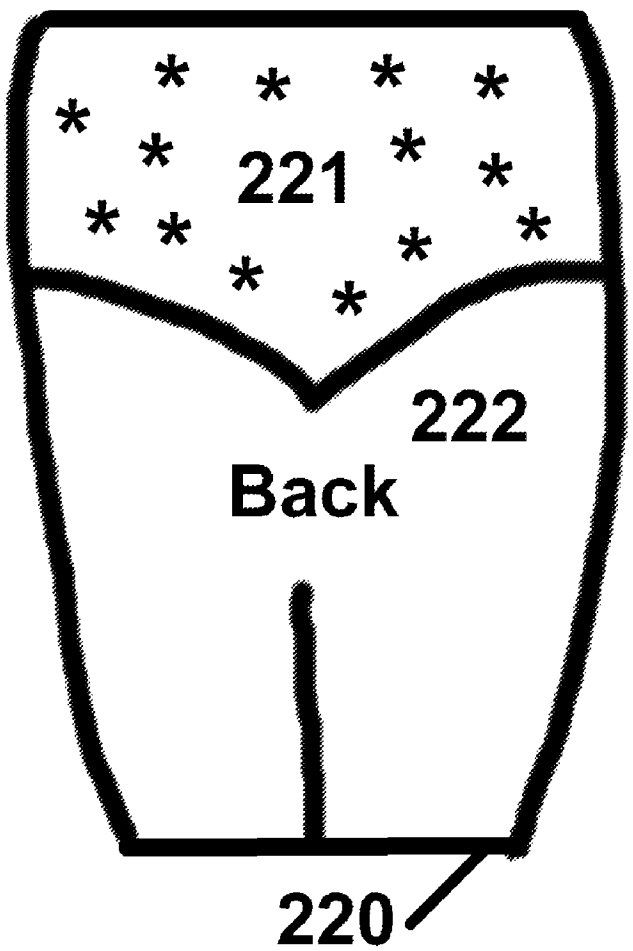
FIGS. 2A and 2B are schematic illustrations of a front side and a back side (respectively) of a garment having reduced-stretch region(s) and conventional stretch region(s), the garment being for example a high-waist underwear or briefs, in accordance with some demonstrative embodiments of the present invention.
Figure 2A:
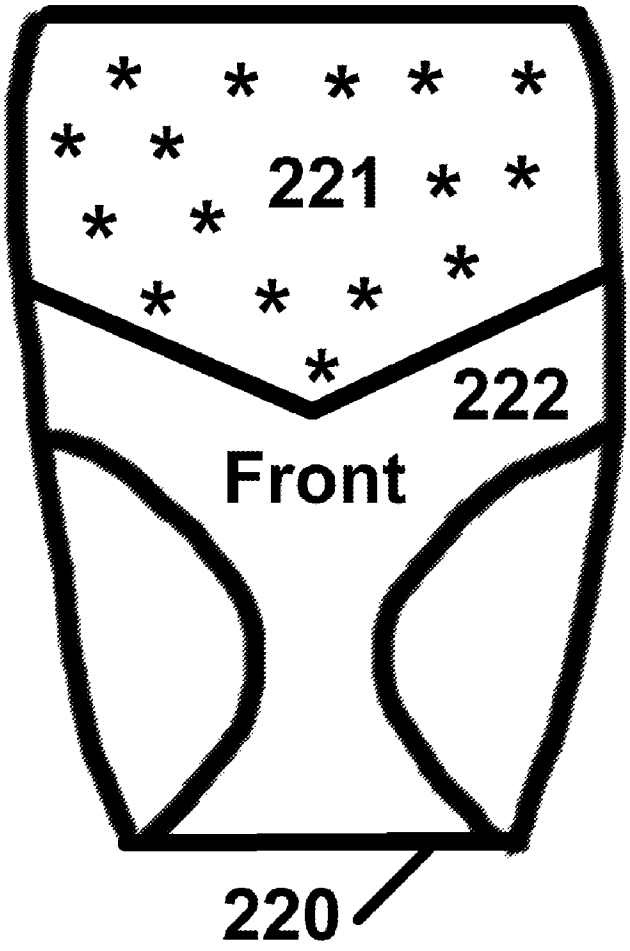

Reference is made to FIGS. 2A and 2B, which are schematic illustrations of a front side and a back side (respectively) of a garment 220 having a reduced-stretch region 221 (which has reduced Horizontal stretch properties) and an adjacent and bordering (e.g., seamlessly neighboring) conventional (e.g., non-reduced) stretch region 222 (which has conventional stretch properties), in accordance with some demonstrative embodiments of the present invention. Garment 220 may be, for example, an underwear or a brief garment, or a high-waist underwear or a high-waist brief garment. Region 221 is further marked with stars, for illustrative purposes. In some embodiments, the capability of region 222 to stretch horizontally, is at least 5 percent greater than the capability of region 221 to stretch horizontally; for example, region 221 has a horizontal stretching capability of K percent; and region 222 has a horizontal stretch capability of at least 1.05 K percent. In other embodiments, the capability of region 222 to stretch horizontally, is at least 10 percent greater than the capability of region 221 to stretch horizontally; for example, region 221 has a horizontal stretching capability of K percent; and region 222 has a horizontal stretch capability of at least 1.10 K percent.

Figure 3A:
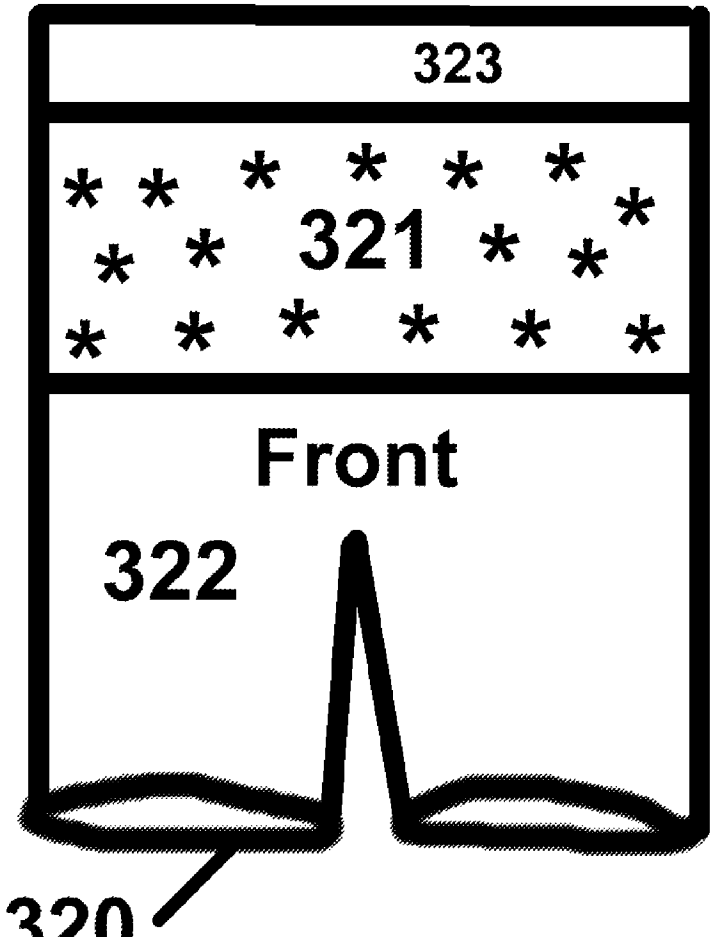
FIGS. 3A and 3B are schematic illustrations of a front side and a back side (respectively) of a garment having reduced-stretch region(s) and conventional stretch region(s), the garment being for example boxers or briefs, in accordance with some demonstrative embodiments of the present invention.
Figure 3B:
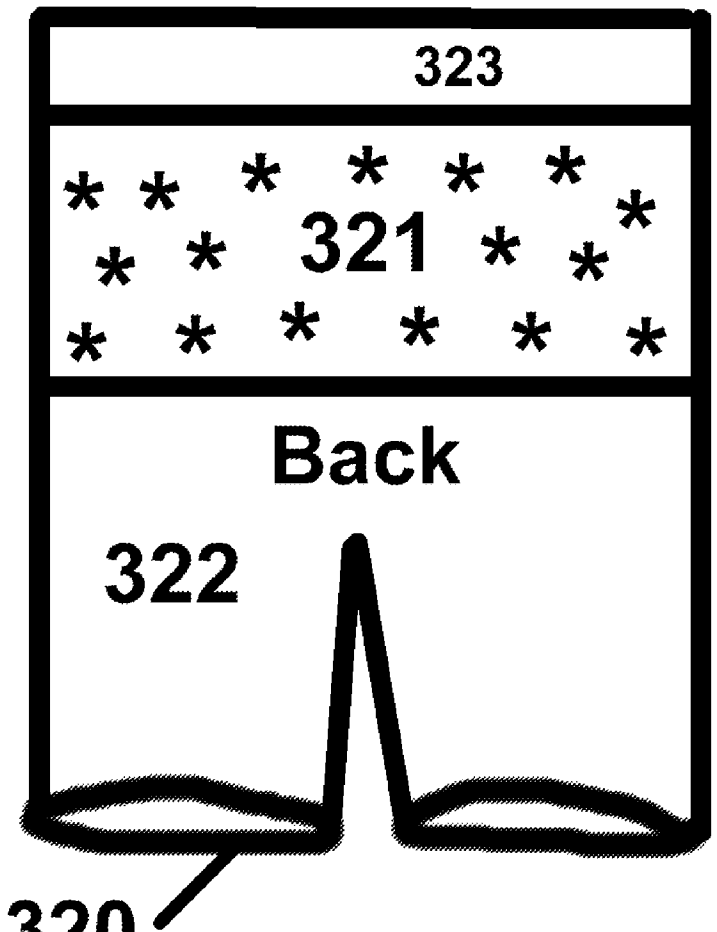

Reference is made to FIGS. 3A and 3B, which are schematic illustrations of a front side and a back side (respectively) of a garment 320 having a reduced-stretch region 321 (which has reduced Horizontal stretch properties) and an adjacent and bordering (e.g., seamlessly neighboring) conventional (e.g., non-reduced) stretch region 322 (which has conventional stretch properties), in accordance with some demonstrative embodiments of the present invention. Garment 320 may be, for example, boxers or underwear. Region 321 is further marked with stars, for illustrative purposes. In some embodiments, the capability of region 322 to stretch horizontally, is at least 5 percent greater than the capability of region 321 to stretch horizontally; for example, region 321 has a horizontal stretching capability of K percent; and region 322 has a horizontal stretch capability of at least 1.05 K percent. In other embodiments, the capability of region 322 to stretch horizontally, is at least 10 percent greater than the capability of region 321 to stretch horizontally; for example, region 321 has a horizontal stretching capability of K percent; and region 322 has a horizontal stretch capability of at least 1.10 K percent. In some embodiments, optionally, a waist-band 323 that is located above region 321 is also a reduced-stretch zone; whereas in other embodiments, the waist-band 323 that is located above region 321 is a conventional-stretch zone.

Figure 4B:
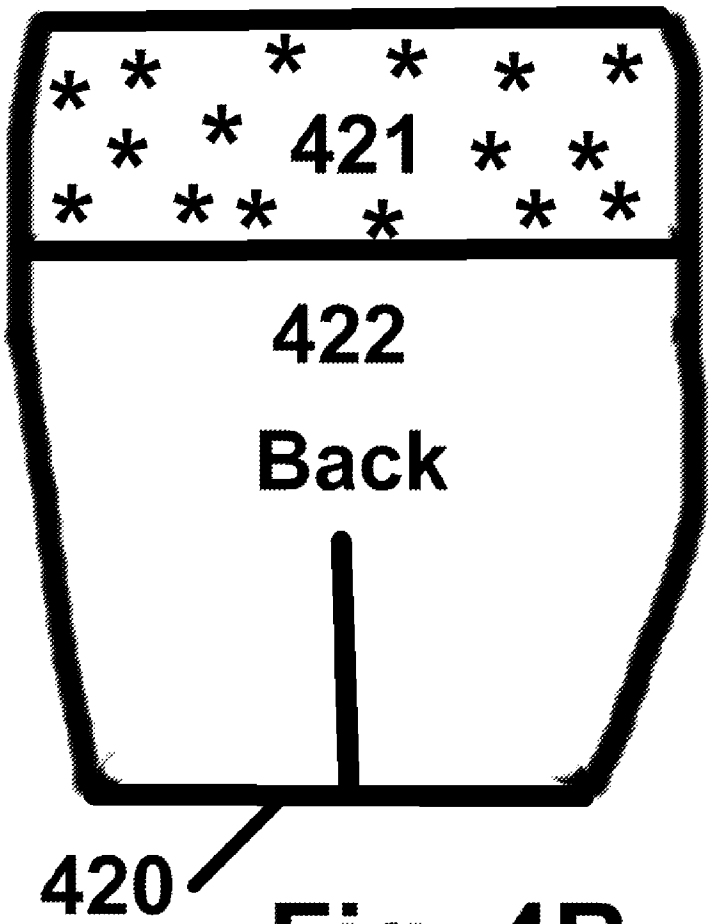
FIGS. 4A and 4B are schematic illustrations of a front side and a back side (respectively) of a garment having reduced-stretch region(s) and conventional stretch region(s), the garment being for example boxers or briefs or a body shaper garment, in accordance with some demonstrative embodiments of the present invention.
Figure 4A:
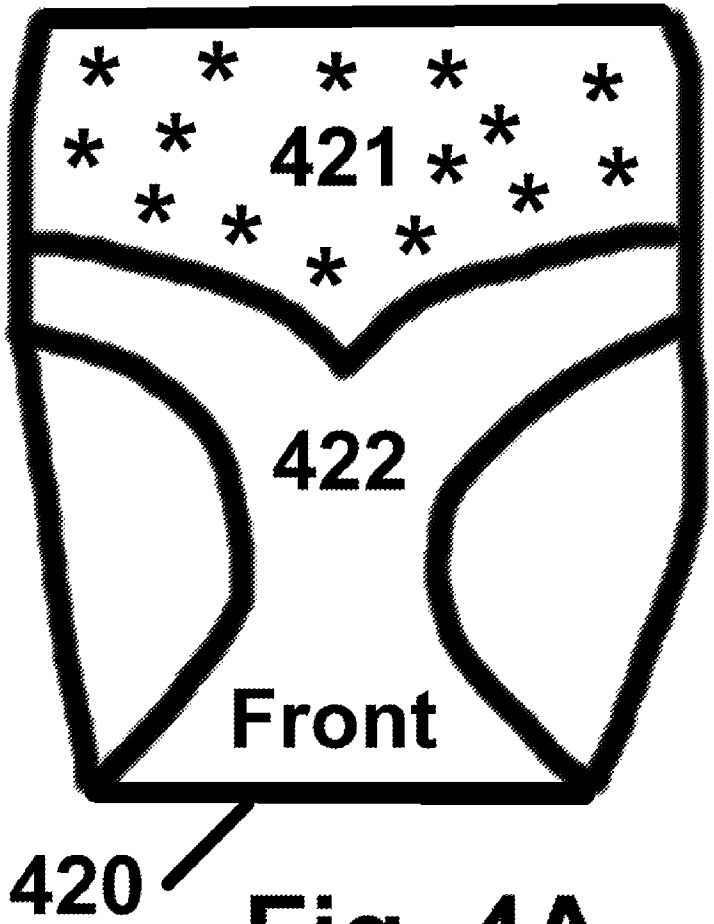

Reference is made to FIGS. 4A and 4B, which are schematic illustrations of a front side and a back side (respectively) of a garment 420 having a reduced-stretch region 421 (which has reduced Horizontal stretch properties) and an adjacent and bordering (e.g., seamlessly neighboring) conventional (e.g., non-reduced) stretch region 422 (which has conventional stretch properties), in accordance with some demonstrative embodiments of the present invention. Garment 420 may be, for example, an underwear or a brief garment or a body shaper garment. Region 421 is further marked with stars, for illustrative purposes. In some embodiments, the capability of region 422 to stretch horizontally, is at least 5 percent greater than the capability of region 421 to stretch horizontally; for example, region 421 has a horizontal stretching capability of K percent; and region 422 has a horizontal stretch capability of at least 1.05 K percent. In other embodiments, the capability of region 422 to stretch horizontally, is at least 10 percent greater than the capability of region 421 to stretch horizontally; for example, region 421 has a horizontal stretching capability of K percent; and region 422 has a horizontal stretch capability of at least 1.10 K percent.

Figure 5B:
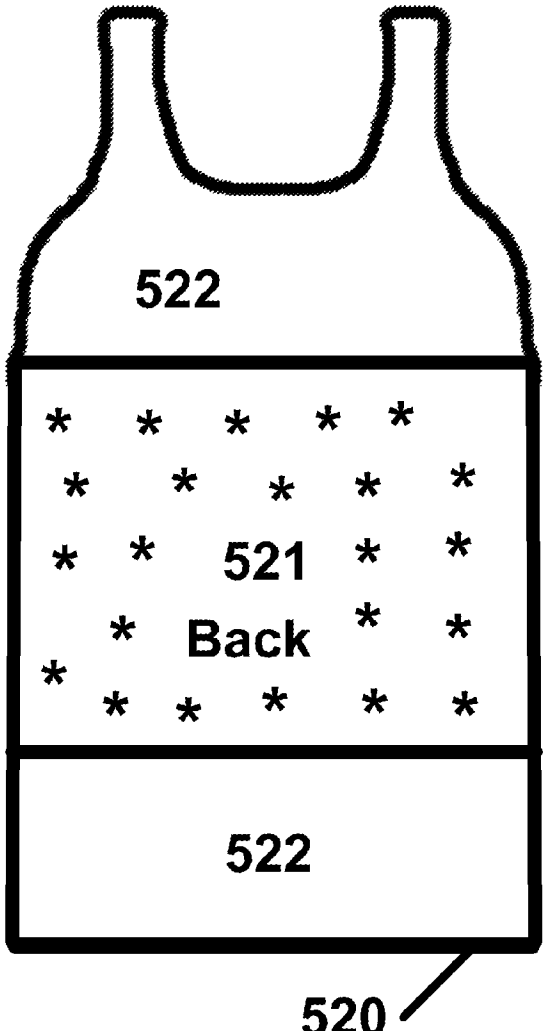
FIGS. 5A and 5B are schematic illustrations of a front side and a back side (respectively) of a garment having reduced-stretch region(s) and conventional stretch region(s), the garment being for example a sleeveless shirt or tank or tank-top garment, in accordance with some demonstrative embodiments of the present invention.
Figure 5A:
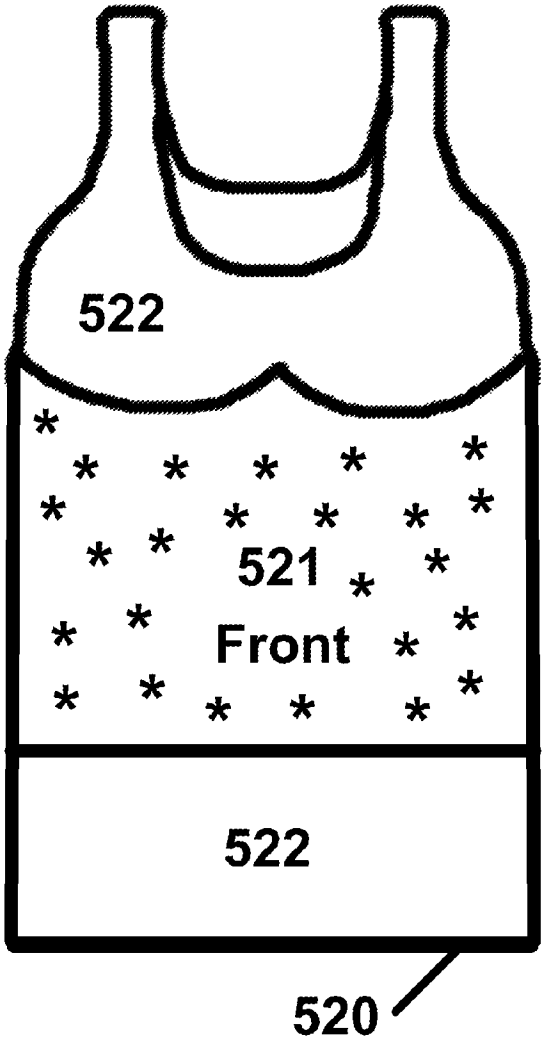

Reference is made to FIGS. 5A and 5B, which are schematic illustrations of a front side and a back side (respectively) of a garment 520 having a reduced-stretch region 521 (which has reduced Horizontal stretch properties) and an adjacent and bordering (e.g., seamlessly neighboring) conventional (e.g., non-reduced) stretch region(s) 522 (which has conventional stretch properties), in accordance with some demonstrative embodiments of the present invention. Garment 520 may be, for example, a sleeveless shirt or tank or tank-top garment. Region 521 is further marked with stars, for illustrative purposes. In some embodiments, the capability of region 522 to stretch horizontally, is at least 5 percent greater than the capability of region 521 to stretch horizontally; for example, region 521 has a horizontal stretching capability of K percent; and region 522 has a horizontal stretch capability of at least 1.05 K percent. In other embodiments, the capability of region 522 to stretch horizontally, is at least 10 percent greater than the capability of region 521 to stretch horizontally; for example, region 521 has a horizontal stretching capability of K percent; and region 522 has a horizontal stretch capability of at least 1.10 K percent.

Figure 6B:
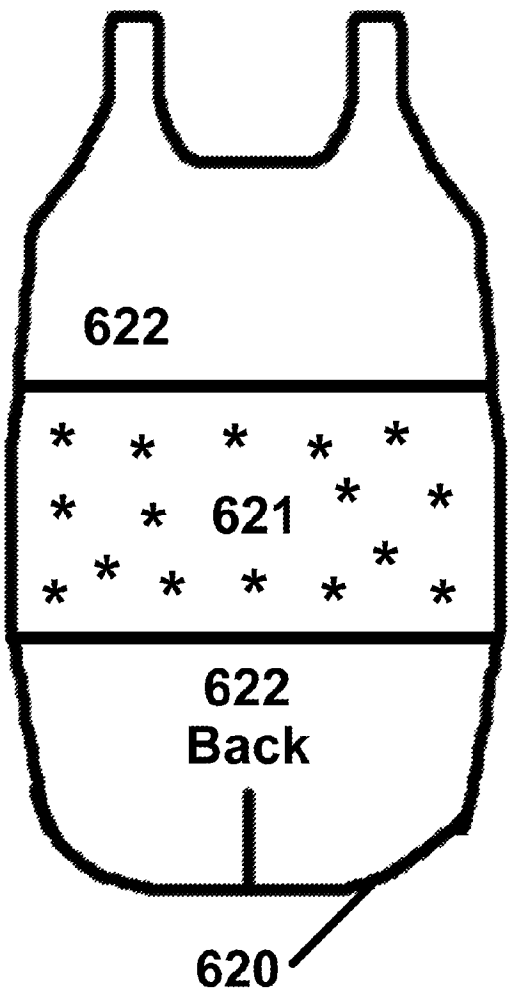
FIGS. 6A and 6B are schematic illustrations of a front side and a back side (respectively) of a garment having reduced-stretch region(s) and conventional stretch region(s), the garment being for example a body suit or a fitness garment, in accordance with some demonstrative embodiments of the present invention.
Figure 6A:
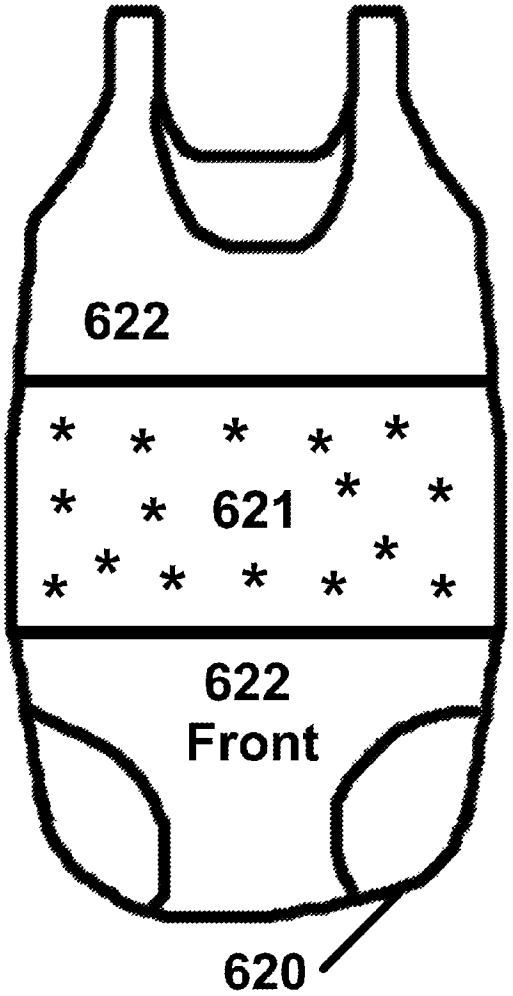

Reference is made to FIGS. 6A and 6B, which are schematic illustrations of a front side and a back side (respectively) of a garment 620 having a reduced-stretch region 621 (which has reduced Horizontal stretch properties) and an adjacent and bordering (e.g., seamlessly neighboring) conventional (e.g., non-reduced) stretch region(s) 622 (which has conventional stretch properties), in accordance with some demonstrative embodiments of the present invention. Garment 620 may be, for example, a body suit or a fitness garment. Region 621 is further marked with stars, for illustrative purposes. In some embodiments, the capability of region 622 to stretch horizontally, is at least 5 percent greater than the capability of region 621 to stretch horizontally; for example, region 621 has a horizontal stretching capability of K percent; and region 622 has a horizontal stretch capability of at least 1.05 K percent. In other embodiments, the capability of region 622 to stretch horizontally, is at least 10 percent greater than the capability of region 621 to stretch horizontally; for example, region 621 has a horizontal stretching capability of K percent; and region 622 has a horizontal stretch capability of at least 1.10 K percent.

Figure 7B:
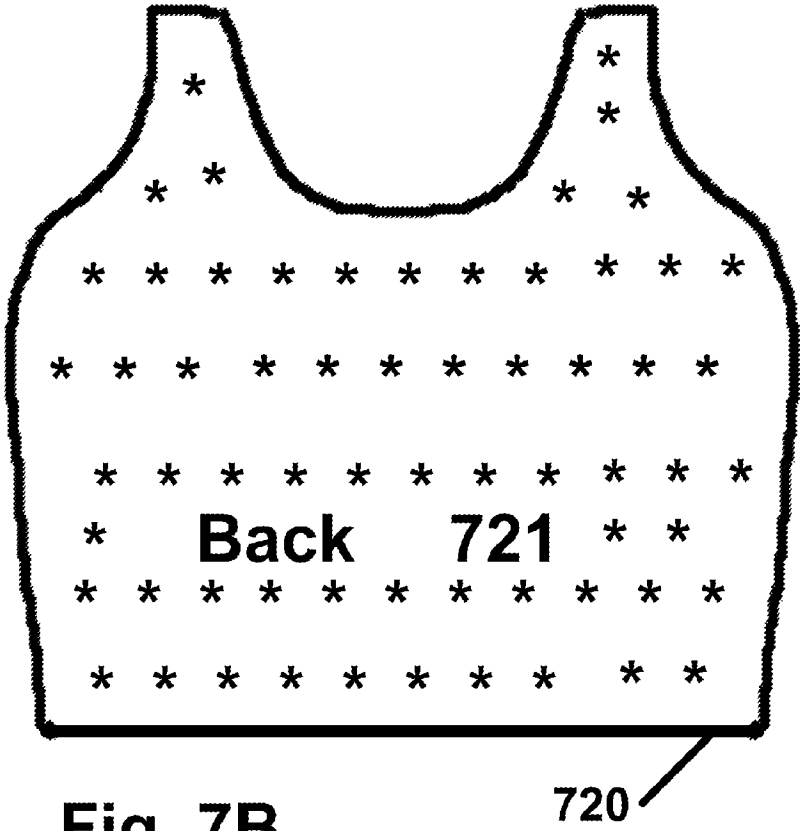
FIGS. 7A and 7B are schematic illustrations of a front side and a back side (respectively) of a garment having reduced-stretch region(s) and conventional stretch region(s), the garment being for example a bra or brassiere or a sports bra or a sports tank-top or an athletic top, in accordance with some demonstrative embodiments of the present invention.
Figure 7A:
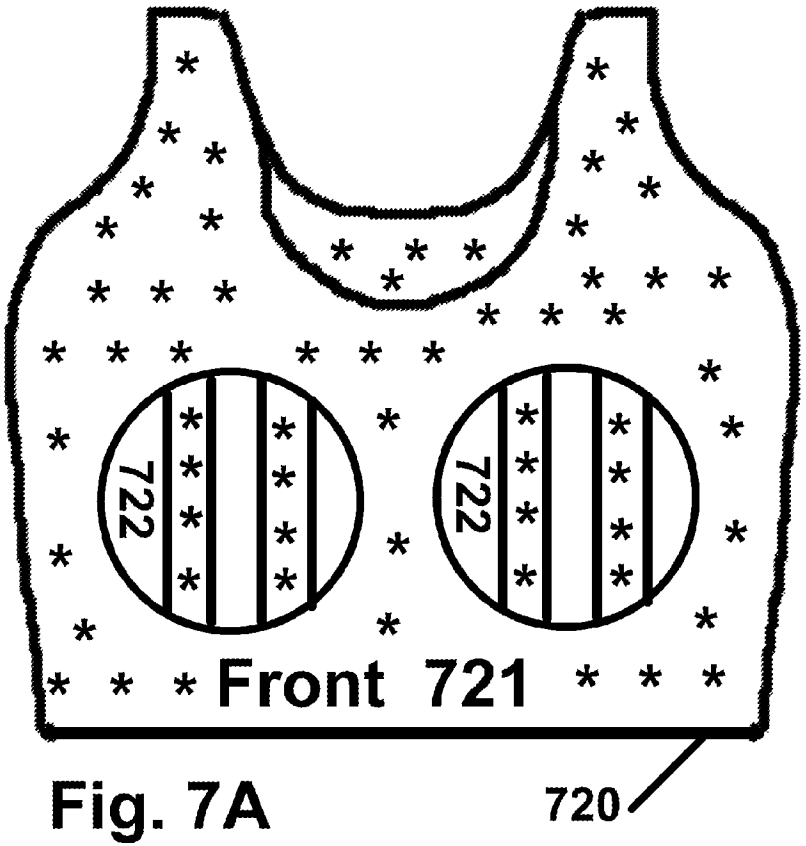

Reference is made to FIGS. 7A and 7B, which are schematic illustrations of a front side and a back side (respectively) of a garment 720 having reduced-stretch regions 721 (each one has reduced Vertical stretch properties) and adjacent and bordering (e.g., seamlessly neighboring) conventional (e.g., non-reduced) stretch regions 722 (each one has conventional stretch properties), in accordance with some demonstrative embodiments of the present invention. Garment 720 may be, for example, a bra or brassiere or a sports bra or a sports tank-top or an athletic top. Regions 721 are further marked with stars, for illustrative purposes. In some embodiments, the capability of region 722 to stretch vertically, is at least 5 percent greater than the capability of region 721 to stretch vertically; for example, region 721 has a vertical stretching capability of K percent; and region 722 has a vertical stretch capability of at least 1.05 K percent. In other embodiments, the capability of region 722 to stretch vertically, is at least 10 percent greater than the capability of region 721 to stretch vertically; for example, region 721 has a vertical stretching capability of K percent; and region 722 has a vertical stretch capability of at least 1.10 K percent. Optionally, almost the entirety of garment 720 is formed of reduced-stretch fabric or regions; with the cups of the bra comprising one or more regions of conventional stretch properties.

Figure 8B:
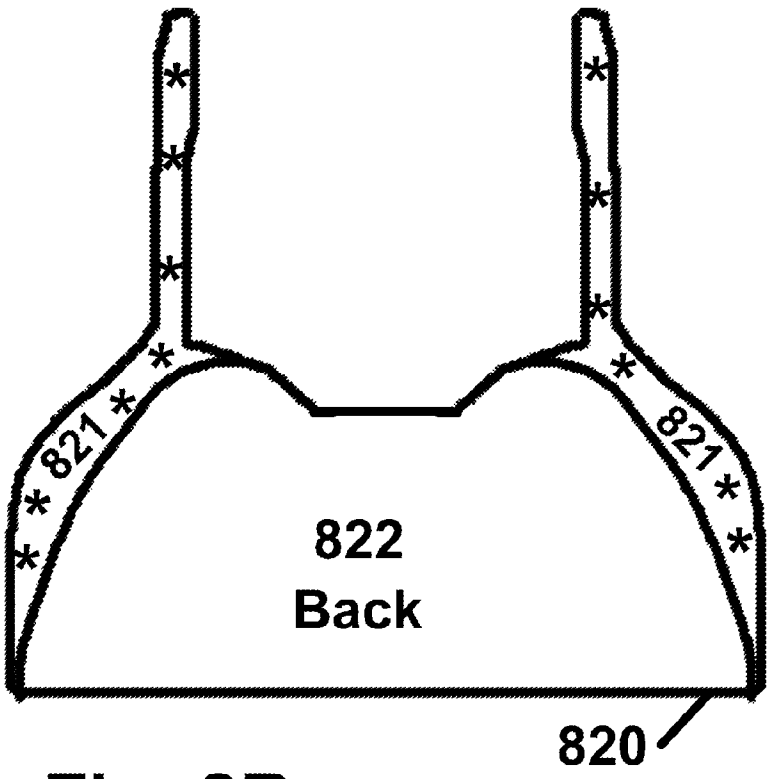
FIGS. 8A and 8B are schematic illustrations of a front side and a back side (respectively) of another garment having reduced-stretch region(s) and conventional stretch region(s), the garment being for example a bra or brassiere or a sports bra or a sports tank-top or an athletic top, in accordance with some demonstrative embodiments of the present invention.
Figure 8A:
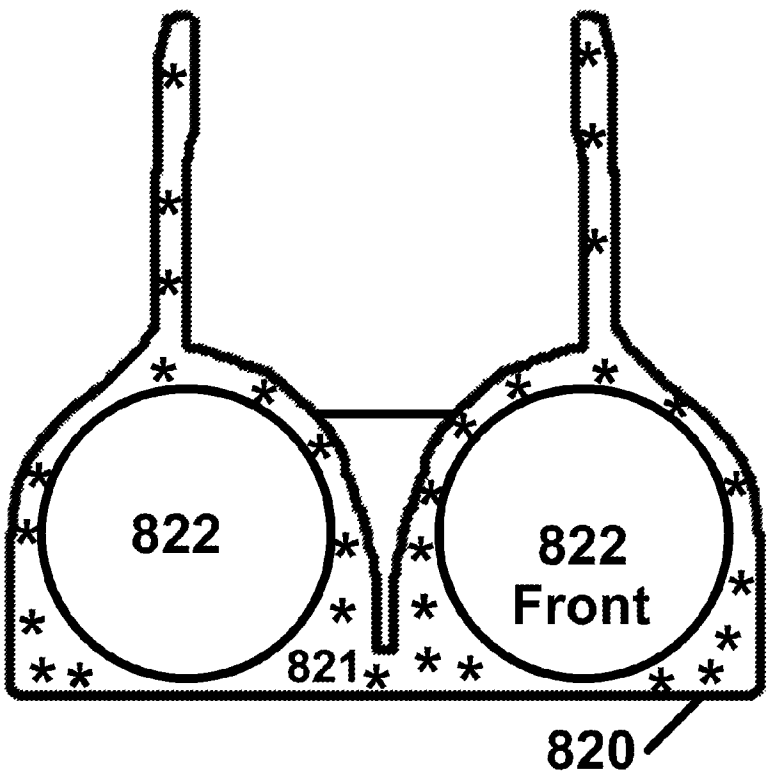

Reference is made to FIGS. 8A and 8B, which are schematic illustrations of a front side and a back side (respectively) of a garment 820 having reduced-stretch regions 821 (each one has reduced Vertical stretch properties) and adjacent and bordering (e.g., seamlessly neighboring) conventional (e.g., non-reduced) stretch regions 822 (each one has conventional stretch properties), in accordance with some demonstrative embodiments of the present invention. Garment 820 may be, for example, a bra or brassiere or a sports bra or a sports tank-top or an athletic top. Regions 821 are further marked with stars, for illustrative purposes. In some embodiments, the capability of region 822 to stretch vertically, is at least 5 percent greater than the capability of region 821 to stretch vertically; for example, region 821 has a vertical stretching capability of K percent; and region 822 has a vertical stretch capability of at least 1.05 K percent. In other embodiments, the capability of region 822 to stretch vertically, is at least 10 percent greater than the capability of region 821 to stretch vertically; for example, region 821 has a vertical stretching capability of K percent; and region 822 has a vertical stretch capability of at least 1.10 K percent. Optionally, almost the entirety of garment 820 is formed of reduced-stretch fabric or regions; with the cups of the bra comprising one or more regions of conventional stretch properties.

Figure 9B:
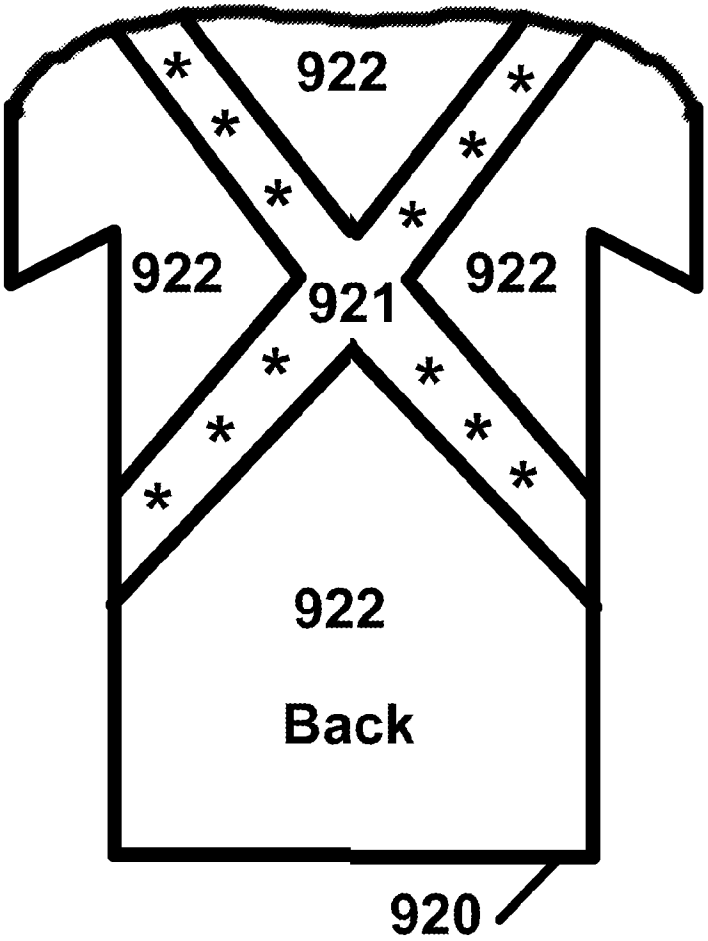
FIGS. 9A and 9B are schematic illustrations of a front side and a back side (respectively) of a garment having reduced-stretch region(s) and conventional stretch region(s), the garment being for example a shirt or a T-shirt or an upper-body garment, in accordance with some demonstrative embodiments of the present invention.
Figure 9A:
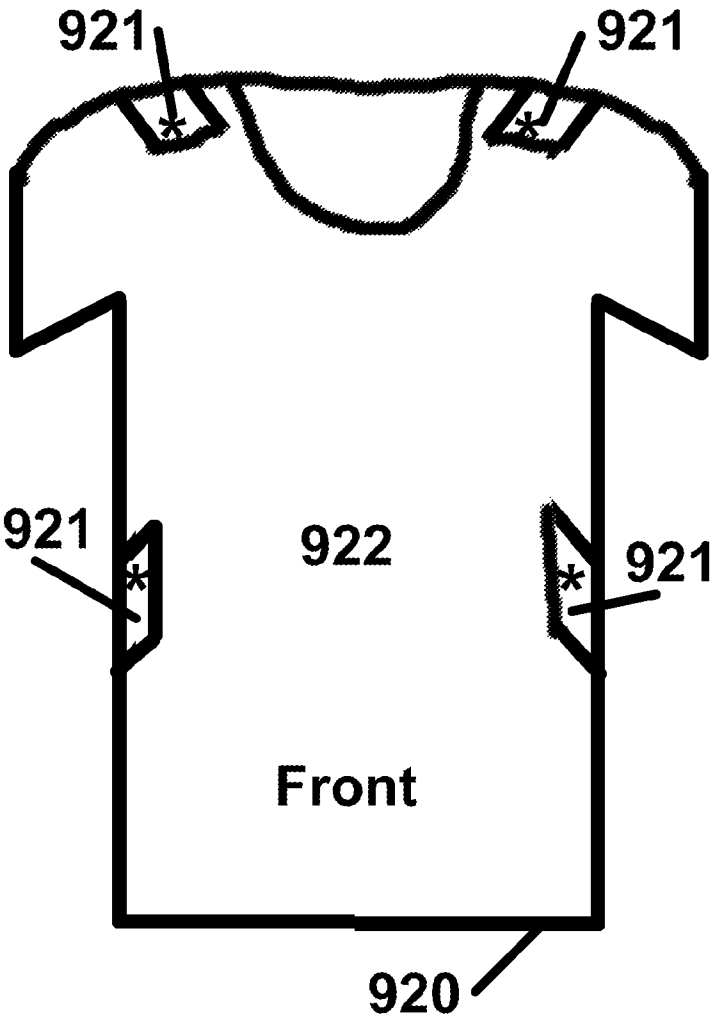

Reference is made to FIGS. 9A and 9B, which are schematic illustrations of a front side and a back side (respectively) of a garment 920 having reduced-stretch regions 921 (each one has reduced Vertical stretch properties) and adjacent and bordering (e.g., seamlessly neighboring) conventional (e.g., non-reduced) stretch regions 922 (each one has conventional stretch properties), in accordance with some demonstrative embodiments of the present invention. Garment 920 may be, for example, a shirt or a T-shirt or an upper-body garment, providing posture control or posture correction to the human wearer, or reminding or assisting the wearer to sit in upright position or posture. Regions 921 are further marked with stars, for illustrative purposes. In some embodiments, the capability of region 922 to stretch vertically, is at least 5 percent greater than the capability of region 921 to stretch vertically; for example, region 921 has a vertical stretching capability of K percent; and region 922 has a vertical stretch capability of at least 1.05 K percent. In other embodiments, the capability of region 922 to stretch vertically, is at least 10 percent greater than the capability of region 921 to stretch vertically; for example, region 921 has a vertical stretching capability of K percent; and region 922 has a vertical stretch capability of at least 1.10 K percent.

Figure 10B:
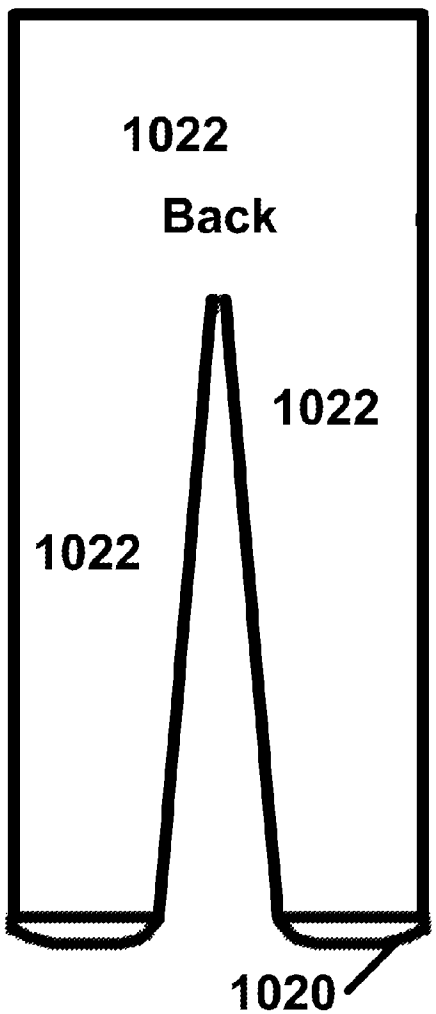
FIGS. 10A and 10B are schematic illustrations of a front side and a back side (respectively) of a garment having reduced-stretch region(s) and conventional stretch region(s), the garment being for example pants or leggings or tights, in accordance with some demonstrative embodiments of the present invention.
Figure 10A:
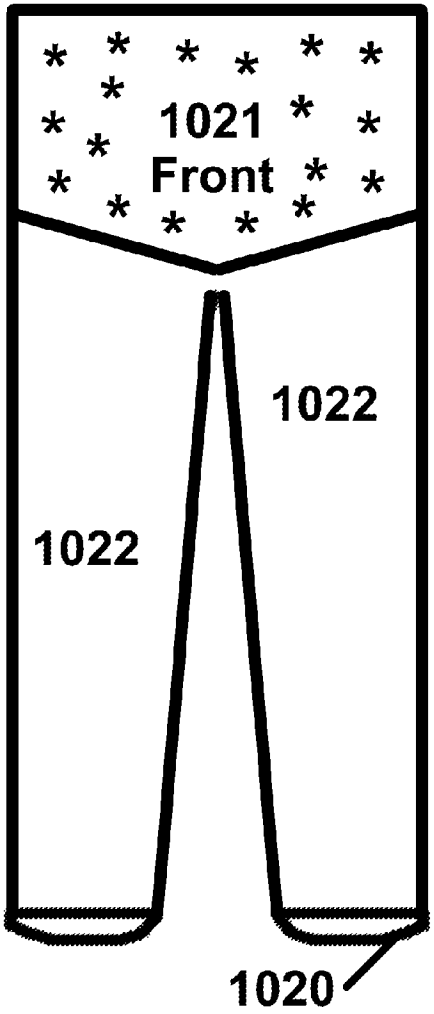

Reference is made to FIGS. 10A and 10B, which are schematic illustrations of a front side and a back side (respectively) of a garment 1020 having a reduced-stretch region 1021 (which has reduced Vertical stretch properties) and adjacent and bordering (e.g., seamlessly neighboring) conventional (e.g., non-reduced) stretch regions 1022 (each one has conventional stretch properties), in accordance with some demonstrative embodiments of the present invention. Garment 1020 may be, for example, pants or leggings or tights or yoga pants or sports pants or sports training pants, with a Front Side Only zero-stretch or reduced-stretch zone or region (region 1021) which remains non-stretched when the human wearer sits down, whereas the back side of the garment has conventional stretch capabilities which enable the back side (and the back side only, and not the front side) to stretch vertically and/or upwardly when the user sits down, thereby preventing or reducing or mitigating a sliding down of the rear side of the pants or leggings or garment during or after sitting down. Region 1021 is further marked with stars, for illustrative purposes. In some embodiments, the capability of region 1022 to stretch vertically, is at least 5 percent greater than the capability of region 1021 to stretch vertically; for example, region 1021 has a vertical stretching capability of K percent; and region 1022 has a vertical stretch capability of at least 1.05 K percent. In other embodiments, the capability of region 1022 to stretch vertically, is at least 10 percent greater than the capability of region 1021 to stretch vertically; for example, region 1021 has a vertical stretching capability of K percent; and region 1022 has a vertical stretch capability of at least 1.10 K percent.

Some embodiments include a garment comprising: a first garment-region, that is formed of a first knitted material, and that is knitted in accordance with a first knitting pattern, wherein the first garment region has a first value of horizontal stretching capacity; a second garment-region, that is formed of said first knitted material, and that is knitted in accordance with a second, different, knitting pattern, wherein the second garment region has a second value of horizontal stretching capacity that is smaller than said first value of horizontal stretching capacity of the first garment-region.

In some embodiments, the second garment-region is immediately adjacent to and is bordering with the first garment-region; wherein the second garment-region and the first garment-region are a continuous and seamless garment zone.

In some embodiments, the first garment-region and the second garment-region have a same value of vertical stretching capacity while having different values of horizontal stretching capacity.

In some embodiments, the second garment-region has an idle non-stretched horizontal length H1, and has a stretched horizontal length H2 upon stretching due to application of human force by a human wearer, wherein H2 is smaller than or equal to 1.05 times H1; wherein the first garment-region has an idle non-stretched horizontal length L1, and has a stretched horizontal length L2 upon stretching due to application of human force by a human wearer, wherein L2 is greater than 1.05 times L1.

In some embodiments, the garment is an underwear or a body shaper garment; wherein the second garment-region covers at least part of buttocks of a human wearer, and has reduced horizontal-stretching capacity relative to horizontal stretching capacity of the first garment-region.

In some embodiments, the garment is a shirt or a chest-covering garment; wherein the second garment-region covers at least part of breasts of a human wearer, and has reduced horizontal-stretching capacity relative to horizontal stretching capacity of the first garment-region.

In some embodiments, the garment is an underwear or a body shaper garment; wherein the second garment-region covers at least part of buttocks of a human wearer, and is generally ring-shaped and encircles the buttocks of the human wearer, and has reduced horizontal-stretching capacity relative to horizontal stretching capacity of the first garment-region.

In some embodiments, the garment is a shirt or a chest-covering garment; wherein the second garment-region covers at least part of breasts of a human wearer, and is generally ring-shaped and encircles the chest of the human wearer, and has reduced horizontal-stretching capacity relative to horizontal stretching capacity of the first garment-region.

In some embodiments, the second garment-region comprises: said first knitted material, structured in a repeat pattern of: a set of one or more knitting lines, each line having alternating knitting points of Miss knitting point and a neighboring Plain knitting point; repeatedly alternating with a set of one or more knitting lines, each line having alternating knitting points of Plain knitting point and a neighboring Miss knitting point.

In some embodiments, the second garment-region comprises: said first knitted material, structured in a repeat pattern of: a set of one or more knitting lines, each line having alternating knitting points of Mesh knitting point and a neighboring Plain knitting point; repeatedly alternating with a set of one or more knitting lines, each line having alternating knitting points of Plain knitting point and a neighboring Mesh knitting point.

In some embodiments, the second garment-region comprises: said first knitted material, structured in a pattern of knitted lines, wherein at least one knitted line comprises a set of alternating Mesh knitting points and Miss knitting points, wherein at least one knitted line comprises a set of alternating Mesh knitting points and Plain knitting points, wherein at least one knitted line comprises a set of alternating Miss knitting points and Plain knitting points.

In some embodiments, the second garment-region comprises: said first knitted material, structured in a repeat pattern of: a set of one or more knitting lines, each line having alternating knitting points of Miss knitting point and a neighboring Laid In knitting point; repeatedly alternating with a set of one or more knitting lines, each line having Plain knitting points.

In some embodiments, the garment is pants or leggings; wherein the second garment-region is knitted in a top area of a front side of the pants or leggings, and is excluded from a rear area of a front side of the pants or leggings, and provides vertical reduced-stretching support to the front side of the pants or leggings and not to the rear side of the pants or leggings.

In some embodiments, the first garment-region comprises only a base knitted material formed of a single knitted yarn; wherein the second garment-region comprises (i) said base knitted material, and also (ii) one or more additional knitted yarns.

In some embodiments, the first garment-region comprises only a base knitted material formed of a two or more knitted yarns; wherein the second garment-region comprises (i) said base knitted material, and also (ii) one or more additional knitted yarns.

In some embodiments, the first garment-region comprises only a base knitted material formed of a single particular knitted yarn; wherein the second garment-region excludes said single particular knitted yarn, and comprises one or more other knitted yarns.

In some embodiments, the first garment-region comprises only a base knitted material formed of a particular set of two or more knitted yarns; wherein the second garment-region excludes said two or more knitted yarns, and comprises one or more other knitted yarns.

Some embodiments include a garment comprising: a first garment-region, that is formed of a first knitted material, and that is knitted in accordance with a first knitting pattern, wherein the first garment region has a first value of vertical stretching capacity; a second garment-region, that is formed of said first knitted material, and that is knitted in accordance with a second, different, knitting pattern, wherein the second garment region has a second value of vertical stretching capacity that is smaller than said first value of vertical stretching capacity of the first garment-region.

In some embodiments, the second garment-region is immediately adjacent to and is bordering with the first garment-region; wherein the second garment-region and the first garment-region are a continuous and seamless garment zone; wherein the first garment-region and the second garment-region have a same value of horizontal stretching capacity while having different values of vertical stretching capacity.

In some embodiments, the second garment-region has an idle non-stretched vertical length V1, and has a stretched vertical length V2 upon stretching due to application of human force by a human wearer, wherein V2 is smaller than or equal to 1.05 times V1; wherein the first garment-region has an idle non-stretched vertical length L1, and has a stretched vertical length L2 upon stretching due to application of human force by a human wearer, wherein L2 is greater than 1.05 times L1.

In some embodiments, the garment is a bra or a sports bra; wherein the second garment-region comprises: (i) a garment-zone that encircles breast cups of the bra or sports bra, and also (ii) a back-wing of the bra or sports bra; wherein the second garment-region excludes the breast cups, and has reduced vertical-stretching capacity relative to vertical-stretching capacity of the first garment-region.

In some embodiments, the garment is a bra or a sports bra; wherein the second garment-region comprises: (i) a garment-zone that encircles breast cups of the bra or sports bra, and also (ii) a back-wing of the bra or sports bra, and also (iii) at least a portion within the breast cups, and has reduced vertical-stretching capacity relative to vertical-stretching capacity of the first garment-region.

In some embodiments, the garment is a shirt; wherein the second garment-region is generally X-shaped and is located at the rear side of the shirt, and provides vertical reduced-stretching posture-support to a back of a human wearer, and has reduced vertical-stretching capacity relative to vertical-stretching capacity of the first garment-region.

In some embodiments, the garment is pants or leggings; wherein the second garment-region is knitted in a top area of a front side of the pants or leggings, and is excluded from a rear area of a front side of the pants or leggings, and provides vertical reduced-stretching support to the front side of the pants or leggings and not to the rear side of the pants or leggings.

In some embodiments, the first garment-region comprises only a base knitted material formed of a single knitted yarn; wherein the second garment-region comprises (i) said base knitted material, and also (ii) one or more additional knitted yarns.

In some embodiments, the first garment-region comprises only a base knitted material formed of a two or more knitted yarns; wherein the second garment-region comprises (i) said base knitted material, and also (ii) one or more additional knitted yarns.

In some embodiments, the first garment-region comprises only a base knitted material formed of a single particular knitted yarn; wherein the second garment-region excludes said single particular knitted yarn, and comprises one or more other knitted yarns.

In some embodiments, the first garment-region comprises only a base knitted material formed of a particular set of two or more knitted yarns; wherein the second garment-region excludes said two or more knitted yarns, and comprises one or more other knitted yarns.

Some embodiments of the present invention may be implemented by using a machine or an automated or semi-automatic production line, which may comprise, for example: cutting unit, welding unit, bonding unit, ultrasonic operations unit, gluing unit, conveyor belt, robotic arm, control unit, workstation; as well as suitable hardware components and/or software components, for example, processor to execute code, memory unit, storage unit, input unit (keyboard, mouse, touch-screen), output unit (screen, touch-screen), modems, transceivers or transmitters or receivers, wireless and/or wired communication links and/or transceivers or transmitters or receivers, power sources, Operating System (OS) and suitable applications, or the like.

Functions, operations, components and/or features described herein with reference to one or more embodiments, may be combined with, or may be utilized in combination with, one or more other functions, operations, components and/or features described herein with reference to one or more other embodiments, or vice versa.

While certain features of some embodiments have been illustrated and described herein, many modifications, substitutions, changes, and equivalents may occur to those skilled in the art. Accordingly, the claims are intended to cover all such modifications, substitutions, changes, and equivalents.

The invention claimed is:

1. A garment comprising:

a first garment-region, that is formed of a first knitted material, and that is knitted in accordance with a first knitting pattern, wherein the first garment region has a first value of horizontal stretching capacity;

a second garment-region, that is formed of said first knitted material, and that is knitted in accordance with a second, different, knitting pattern, wherein the second garment region has a second value of horizontal stretching capacity that is smaller than said first value of horizontal stretching capacity of the first garment-region;

wherein the second garment-region is immediately adjacent to and is bordering with the first garment-region, wherein the second garment-region and the first garment-region are a continuous and seamless garment zone, formed seamlessly and continuously by a seamless circular knitting machine;

wherein the first garment-region and the second garment-region have a same value of vertical stretching capacity while having different values of horizontal stretching capacity;

wherein the second garment-region has an idle non-stretched horizontal length H1, and has a stretched horizontal length H2 upon stretching due to application of human force by a human wearer, wherein H2 is smaller than or equal to 1.05 times H1;

wherein the first garment-region has an idle non-stretched horizontal length L1, and has a stretched horizontal length L2 upon stretching due to application of human force by a human wearer, wherein L2 is greater than 1.05 times L1.

2. The garment according to claim 1, wherein the garment is an underwear or a body shaper garment, wherein the second garment-region covers at least part of buttocks of a human wearer, and has reduced horizontal-stretching capacity relative to horizontal stretching capacity of the first garment-region.

3. The garment according to claim 1, wherein the garment is a shirt or a chest-covering garment, wherein the second garment-region covers at least part of breasts of a human wearer, and has reduced horizontal-stretching capacity relative to horizontal stretching capacity of the first garment-region.

4. The garment according to claim 1, wherein the garment is an underwear or a body shaper garment, wherein the second garment-region covers at least part of buttocks of a human wearer, and is generally ring-shaped and encircles the buttocks of the human wearer, and has reduced horizontal-stretching capacity relative to horizontal stretching capacity of the first garment-region.

5. The garment according to claim 1, wherein the garment is a shirt or a chest-covering garment, wherein the second garment-region covers at least part of breasts of a human wearer, and is generally ring-shaped and encircles the chest of the human wearer, and has reduced horizontal-stretching capacity relative to horizontal stretching capacity of the first garment-region.

6. The garment according to claim 1, wherein the second garment-region comprises:

said first knitted material, structured in a repeat pattern of:

a set of one or more knitting lines, each line having alternating knitting points of Miss knitting point and a neighboring Plain knitting point;

repeatedly alternating with a set of one or more knitting lines, each line having alternating knitting points of Plain knitting point and a neighboring Miss knitting point.

7. The garment according to claim 1, wherein the second garment-region comprises:

said first knitted material, structured in a repeat pattern of:

a set of one or more knitting lines, each line having alternating knitting points of Mesh knitting point and a neighboring Plain knitting point;

repeatedly alternating with a set of one or more knitting lines, each line having alternating knitting points of Plain knitting point and a neighboring Mesh knitting point.

8. The garment according to claim 1, wherein the second garment-region comprises:

said first knitted material, structured in a pattern of knitted lines, wherein at least one knitted line comprises a set of alternating Mesh knitting points and Miss knitting points, wherein at least one knitted line comprises a set of alternating Mesh knitting points and Plain knitting points, wherein at least one knitted line comprises a set of alternating Miss knitting points and Plain knitting points.

9. The garment according to claim 1, wherein the second garment-region comprises:

said first knitted material, structured in a repeat pattern of:

a set of one or more knitting lines, each line having alternating knitting points of Miss knitting point and a neighboring Laid In knitting point;

repeatedly alternating with a set of one or more knitting lines, each line having Plain knitting points.

10. The garment according to claim 1, wherein the garment is pants or leggings, wherein the second garment-region is knitted in a top area of a front side of the pants or leggings, and is excluded from a rear area of a front side of the pants or leggings, and provides vertical reduced-stretching support to the front side of the pants or leggings and not to the rear side of the pants or leggings.

11. The garment according to claim 1, wherein the first garment-region comprises only a base knitted material formed of a single knitted yarn;

wherein the second garment-region comprises (i) said base knitted material, and also (ii) one or more additional knitted yarns.

12. The garment according to claim 1, wherein the first garment-region comprises only a base knitted material formed of a two or more knitted yarns;

wherein the second garment-region comprises (i) said base knitted material, and also (ii) one or more additional knitted yarns.

13. The garment according to claim 1, wherein the first garment-region comprises only a base knitted material formed of a single particular knitted yarn;

wherein the second garment-region excludes said single particular knitted yarn, and comprises one or more other knitted yarns.

14. The garment according to claim 1, wherein the first garment-region comprises only a base knitted material formed of a particular set of two or more knitted yarns;

wherein the second garment-region excludes said two or more knitted yarns, and comprises one or more other knitted yarns.

15. A garment comprising:

a first garment-region, that is formed of a first knitted material, and that is knitted in accordance with a first knitting pattern, wherein the first garment region has a first value of vertical stretching capacity;

a second garment-region, that is formed of said first knitted material, and that is knitted in accordance with a second, different, knitting pattern, wherein the second garment region has a second value of vertical stretching capacity that is smaller than said first value of vertical stretching capacity of the first garment-region;

wherein the second garment-region is immediately adjacent to and is bordering with the first garment-region;

wherein the second garment-region and the first garment-region are a continuous and seamless garment zone, formed seamlessly and continuously by a seamless circular knitting machine;

wherein the first garment-region and the second garment-region have a same value of horizontal stretching capacity while having different values of vertical stretching capacity;

wherein the second garment-region has an idle non-stretched vertical length V1, and has a stretched vertical length V2 upon stretching due to application of human force by a human wearer, wherein V2 is smaller than or equal to 1.05 times V1;

wherein the first garment-region has an idle non-stretched vertical length L1, and has a stretched vertical length L2 upon stretching due to application of human force by a human wearer, wherein L2 is greater than 1.05 times L1.

16. The garment according to claim 15, wherein the garment is a bra or a sports bra, wherein the second garment-region comprises: (i) a garment-zone that encircles breast cups of the bra or sports bra, and also (ii) a back-wing of the bra or sports bra, wherein the second garment-region excludes the breast cups, and has reduced vertical-stretching capacity relative to vertical-stretching capacity of the first garment-region.

17. The garment according to claim 15, wherein the garment is a bra or a sports bra, wherein the second garment-region comprises: (i) a garment-zone that encircles breast cups of the bra or sports bra, and also (ii) a back-wing of the bra or sports bra, and also (iii) at least a portion within the breast cups, and has reduced vertical-stretching capacity relative to vertical-stretching capacity of the first garment-region.

18. The garment according to claim 15, wherein the garment is a shirt, wherein the second garment-region is generally X-shaped and is located at the rear side of the shirt, and provides vertical reduced-stretching posture-support to a back of a human wearer, and has reduced vertical-stretching capacity relative to vertical-stretching capacity of the first garment-region.

19. The garment according to claim 15, wherein the garment is pants or leggings, wherein the second garment-region is knitted in a top area of a front side of the pants or leggings, and is excluded from a rear area of a front side of the pants or leggings, and provides vertical reduced-stretching support to the front side of the pants or leggings and not to the rear side of the pants or leggings.

20. The garment according to claim 15, wherein the first garment-region comprises only a base knitted material formed of a single knitted yarn;

wherein the second garment-region comprises (i) said base knitted material, and also (ii) one or more additional knitted yarns.

21. The garment according to claim 15, wherein the first garment-region comprises only a base knitted material formed of a two or more knitted yarns;

wherein the second garment-region comprises (i) said base knitted material, and also (ii) one or more additional knitted yarns.

22. The garment according to claim 15, wherein the first garment-region comprises only a base knitted material formed of a single particular knitted yarn;

wherein the second garment-region excludes said single particular knitted yarn, and comprises one or more other knitted yarns.

23. The garment according to claim 15, wherein the first garment-region comprises only a base knitted material formed of a particular set of two or more knitted yarns;

wherein the second garment-region excludes said two or more knitted yarns, and comprises one or more other knitted yarns.

* * * * *